US012736280B2

(12) United States Patent
Kromer et al.

(10) Patent No.: US 12,736,280 B2
(45) Date of Patent: Sep. 15, 2026

(54) SYSTEM AND METHOD FOR CO-PRODUCTION OF A DENSIFIED LIQUID OXYGEN PRODUCT AND DENSIFIED LIQUID METHANE PRODUCT

(71) Applicants: Brian R. Kromer, Tonawanda, NY (US); Seth A. Potratz, Tonawanda, NY (US); Sean M. Kelly, Tonawanda, NY (US)

(72) Inventors: Brian R. Kromer, Tonawanda, NY (US); Seth A. Potratz, Tonawanda, NY (US); Sean M. Kelly, Tonawanda, NY (US)

(73) Assignee: Praxair Technology, Inc., Danbury, CT (US)

( * ) Notice: Subject to any disclaimer, the term of this patent is extended or adjusted under 35 U.S.C. 154(b) by 195 days.

(21) Appl. No.: 18/402,076

(22) Filed: Jan. 2, 2024

(65) Prior Publication Data

US 2024/0230221 A1 Jul. 11, 2024

Related U.S. Application Data

(60) Provisional application No. 63/493,175, filed on Mar. 30, 2023, provisional application No. 63/478,547, filed on Jan. 5, 2023.

(51) Int. Cl.
*F25J 1/00* (2006.01)
*F25J 1/02* (2006.01)

(52) U.S. Cl.
CPC ..... *F25J 1/0215* (2013.01); *F25J 1/0017* (2013.01); *F25J 1/0022* (2013.01); *F25J 1/0057* (2013.01);

(Continued)

(58) Field of Classification Search
CPC ..... F25J 1/0022; F25J 1/0017; F25J 1/0072; F25J 1/0234; F25J 1/001; F25J 2290/50; F25J 2270/42; F25J 2215/04
See application file for complete search history.

(56) References Cited

U.S. PATENT DOCUMENTS 3,724,226 A * 4/1973 Pachaly ..... F25J 3/0247 62/613
10,808,967 B2 10/2020 Prosser et al.
(Continued)

FOREIGN PATENT DOCUMENTS

CN 113375420 A 9/2021
CN 216924913 U 7/2022
(Continued)

OTHER PUBLICATIONS

Springmann: "Plan large o2 and n2 plants",Hydrocarbon Processing, Gulf Publishing Co. Houston, US,vol. 56, No. 2,Jan. 1, 1977,pp. 97-101,XP009117396.

(Continued)

*Primary Examiner* — Brian M King
(74) *Attorney, Agent, or Firm* — Robert J. Hampsch

(57) ABSTRACT

A system and method for the co-production of a densified, liquid oxidant and a densified liquid methane fuel to a space vehicle launch facility is provided. In one embodiment, a low pressure gaseous oxygen stream is piped from a nearby air separation unit to the space vehicle launch facility where it is then liquefied and densified in a two-stage, integrated liquefaction/densification system that also densifies a source of liquid methane. In an alternate embodiment, a liquid oxygen stream produced at an air separation unit is densified in a two-stage, integrated densification system configured to densify both the liquid oxygen as well a source of liquid methane at or near the air separation unit with the resulting (Continued)

densified liquid products transported via truck/trailer to a nearby space vehicle launch facility.

14 Claims, 5 Drawing Sheets

(52) U.S. Cl.
CPC ..... *F25J 1/0062* (2013.01); *F25J 1/0072* (2013.01); *F25J 1/0229* (2013.01); *F25J 1/0234* (2013.01); *F25J 1/0292* (2013.01); *F25J 2215/04* (2013.01); *F25J 2215/50* (2013.01); *F25J 2215/60* (2013.01); *F25J 2230/42* (2013.01); *F25J 2245/42* (2013.01); *F25J 2260/50* (2013.01); *F25J 2260/60* (2013.01); *F25J 2270/60* (2013.01); *F25J 2270/66* (2013.01)

(56) References Cited

U.S. PATENT DOCUMENTS

| | | | | |
|---|---|---|---|---|
| 11,293,671 | B2 | 4/2022 | Prosser et al. | |
| 2005/0210914 | A1* | 9/2005 | Allam | F25J 1/0067 62/607 |
| 2009/0217701 | A1* | 9/2009 | Minta | F25J 1/0288 62/612 |
| 2017/0038133 | A1 | 2/2017 | Turney et al. | |
| 2017/0038136 | A1* | 2/2017 | Turney | F25J 1/0022 |
| 2018/0202690 | A1* | 7/2018 | Prosser | F25J 1/0275 |
| 2022/0099364 | A1* | 3/2022 | Turney | F25J 1/0221 |
| 2022/0333852 | A1 | 10/2022 | Howard | |
| 2022/0333853 | A1 | 10/2022 | Howard | |
| 2022/0333854 | A1 | 10/2022 | Howard | |
| 2022/0333855 | A1 | 10/2022 | Howard | |
| 2022/0333856 | A1 | 10/2022 | Howard | |
| 2022/0333858 | A1 | 10/2022 | Howard | |
| 2022/0404094 | A1 | 12/2022 | Prosser | |
| 2023/0009727 | A1* | 1/2023 | Turney | F25J 1/004 |
| 2023/0068126 | A1 | 3/2023 | Turney et al. | |
| 2023/0113326 | A1* | 4/2023 | Howard | F25J 1/0204 62/613 |
| 2023/0114229 | A1 | 4/2023 | Edward | |
| 2023/0115492 | A1 | 4/2023 | Howard | |
| 2023/0129424 | A1 | 4/2023 | Howard | |
| 2023/0395829 | A1 | 12/2023 | Nagimov | |

FOREIGN PATENT DOCUMENTS

| | | | |
|---|---|---|---|
| JP | S61282780 | A | 12/1986 |
| JP | H0914830 | A * | 1/1997 |
| JP | 3303101 | B2 | 7/2002 |

OTHER PUBLICATIONS

Roland Michely: "Luftzerlegungsanlagen im Parallelbetrieb",Linde Berichte aus Technik & Wissenschaft, No. 43, Jun. 1, 1978, pp. 39-44, XP001253417.

* cited by examiner

SYSTEM AND METHOD FOR CO-PRODUCTION OF A DENSIFIED LIQUID OXYGEN PRODUCT AND DENSIFIED LIQUID METHANE PRODUCT

CROSS REFERENCE TO RELATED APPLICATIONS

This application claims the benefit of and priority to U.S. provisional patent application Ser. Nos. 63/478,547 filed on Jan. 5, 2023 and 63/493,175 filed on Mar. 30, 2023 the disclosures of which are incorporated by reference.

TECHNICAL FIELD

The present invention relates to a system and method for the co-production and supply of a densified liquid oxygen product and densified liquid methane product for use in space vehicle applications

BACKGROUND

Space vehicle launches require large quantities of liquid fuels and liquid oxygen to create the propulsion necessary to get the vehicle to space. Minimizing the volume and weight of the fuel/oxygen tanks is critically important to the viability of a rocket design. It is desired to fit all the necessary fuel into as small a volume as possible. Typically, cryogenic liquids are produced and stored in tanks in equilibrium with vapor at the liquid's boiling point temperature. Subcooling the liquids below their boiling points can create a denser fluid which requires smaller tanks to hold the same volume. The limit to the level of densification is solidification at the triple point of the material.

Depending on the size of the space vehicle, supply of the liquid oxygen to a launch platform at a launch facility typically requires in excess of 40 trailers of liquid oxygen to be trucked into the launch facility where the liquid oxygen is then densified. Similarly, liquid propellants such as liquid methane are also trucked to the launch facility Cryogenic refrigeration systems have been used for decades in many rocket or space applications for purposes such as propellant or oxidant densification. For propellant or oxidant densification, the removal of sensible heat from a liquid propellant or oxidant, such as liquid oxygen, increases the density of the liquid, which is solely dependent on temperature since liquids are generally considered incompressible. Challenges facing the space industry related to propellant densification include reducing the operational and capital cost of propellant densification as well as reducing the time it takes to achieve the desired temperatures. Examples of cryogenic based liquid oxygen densification systems are shown and described in U.S. Pat. Nos. 10,808,967 and 11,293,671.

Another challenge in propellant and oxidant densification is that it typically is performed at the liquid storage location near the launch platform using liquid nitrogen as the densification refrigerant. Current oxidant densification typically require more trailers of liquid nitrogen to be trucked in from external sources than trailers of liquid oxygen are required to densify the liquid oxygen which increases the overall logistics burden of trucking in liquid cryogens to the launch facility. The liquid nitrogen densification refrigerant is used just for cooling and thus is a consumable within the process.

However, to further improve launch operations and reduce operating costs, there is a need to reduce or eliminate the transport of liquid oxygen via trucks to the launch facility and improve the supply arrangements for liquid propellants and oxidants. Thus, there is a continuing need to develop improved refrigeration cycles for liquefaction of gaseous oxygen and the densification of the resulting liquid oxygen as well as densification of other liquid propellants at the launch facility for use in launching space vehicles.

SUMMARY

The present invention may be characterized as a system for co-production of a densified, liquid oxygen stream and a densified liquid methane stream comprising: (i) a first refrigeration stage configured to receive a first refrigerant and flow the first refrigerant through a first primary heat exchanger to cool the gaseous oxygen stream and then through a first subcooler to subcool and liquefy the cooled gaseous oxygen stream via indirect heat exchange with a residual portion the first refrigerant to yield a liquid oxygen stream; (ii) a second refrigeration stage configured to flow a second refrigerant through the second heat exchanger to subcool the liquid oxygen stream and yield a densified, liquid oxygen stream; and (iii) a third refrigeration stage comprising a third heat exchanger configured to densify a stream of liquid methane via indirect heat exchange with a diverted portion of the first refrigerant stream to yield a densified, liquid methane stream.

The present invention may be characterized as a system for co-production of a densified, liquid oxygen stream from a liquid oxygen stream and a densified liquid methane stream comprising: (i) a first refrigeration stage configured to receive a first refrigerant and flow the first refrigerant through at least one first heat exchanger; (ii) a second refrigeration stage configured to flow a second refrigerant through a second heat exchanger configured to cool the second refrigerant via indirect heat exchange with one or more streams of the first refrigerant and configured to flow the second refrigerant through a densification heat exchanger to subcool and densify a liquid oxygen stream via indirect heat exchange with the second refrigerant; and (iii) a third refrigeration stage comprising a third heat exchanger configured to densify a stream of liquid methane via indirect heat exchange with a diverted portion of the expanded residual stream to yield a densified, liquid methane stream.

BRIEF DESCRIPTION OF DRAWINGS

It is believed that the claimed system and method will be better understood when taken in connection with the accompanying drawings in which:

FIG. 1A shows a schematic illustration of a conventional prior art arrangement for the supply of a liquid oxidant to a launch site where it is densified prior to use in a space vehicle launch while

DETAILED DESCRIPTION

Figure 1A:
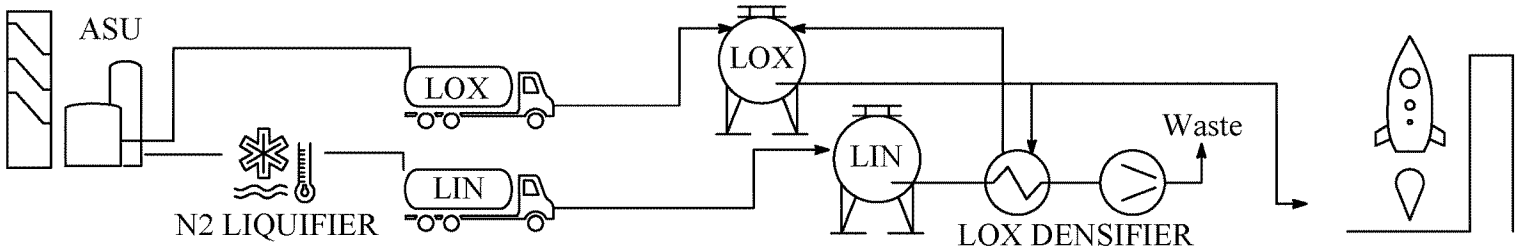
FIG. 1A (PRIOR ART)

Turning to FIG. 1A the conventional or prior art method of supplying a densified liquid oxygen product to a space launch vehicle is schematically depicted. Multiple trailers of liquid oxygen produced at an air separation unit are delivered via trucks to a launch facility where the liquid oxygen is densified using conventional liquid oxygen densification systems such as those shown and described in U.S. Pat. Nos. 10,808,967 and 11,293,671. To densify the liquid oxygen at the launch site requires large volumes of liquid nitrogen which is also delivered via trucks to the liquid oxygen densification system at the launch facility. Typically about twice as much liquid nitrogen by volume is required to densify the liquid oxygen and the nitrogen is usually vented to the atmosphere after such use in the conventional liquid oxygen densification system.

Figure 1B:
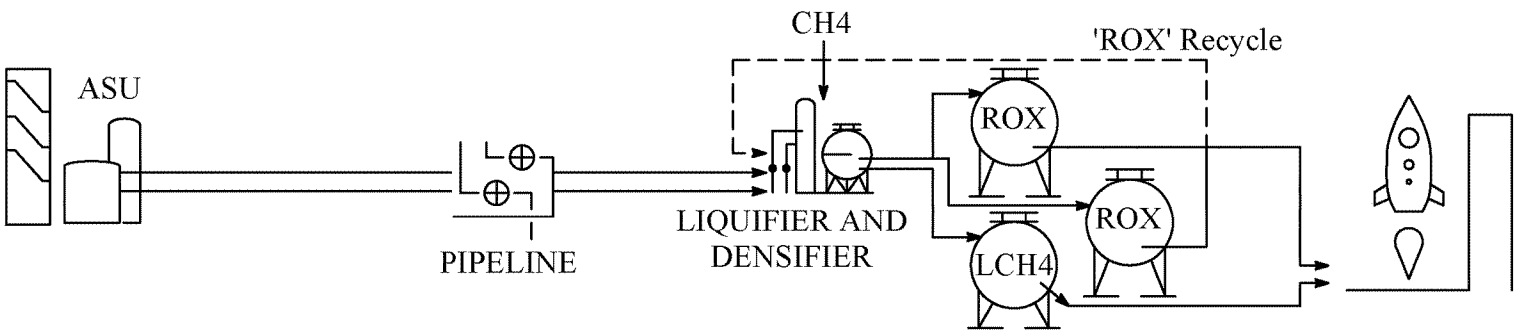
FIGS. 1B and 1C show schematic illustrations of the present arrangements for the supply of a densified, liquid oxidant products and densified liquid methane products to or at a launch site for use in a space vehicle launch.

Turning now to FIG. 1B, there is shown an improved arrangement for the supply of a densified, liquid oxidant (i.e. ROX™) to a launch facility for use in a space vehicle launch. As seen therein, gaseous oxygen is produced by an oxygen and nitrogen producing air separation unit located in proximity to a space vehicle launch facility, that includes one or more space vehicle launch platforms. The gaseous oxygen stream is delivered to the space vehicle launch facility via oxygen pipeline. Optionally, a nitrogen stream (liquid or gaseous) may also be directed via a nitrogen pipeline from the air separation unit to the space vehicle launch facility. The gaseous oxygen and optional nitrogen are directed to a combined liquefaction and densification system where the gaseous oxygen stream is liquefied with the resulting liquid oxygen stream being densified, and a source of methane is also liquified and/or densified as generally described in more detail below with reference to FIGS. 2-3.

Figure 1C:
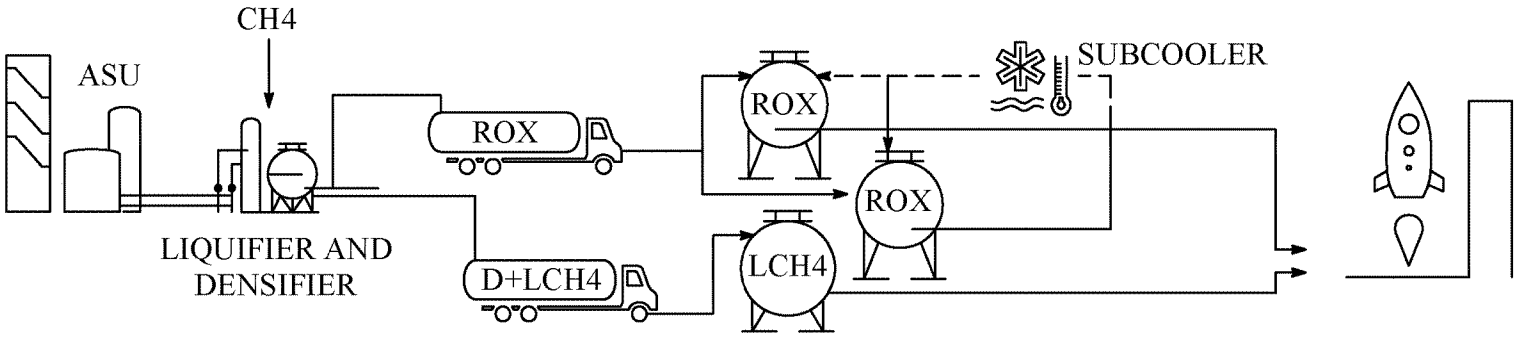

Turning now to FIG. 1C, there is shown another improved arrangement for the supply of a densified, liquid oxidant to a launch facility for use in a space vehicle launch. As seen therein, oxygen and nitrogen are produced by an oxygen and nitrogen producing air separation unit located in proximity to a space vehicle launch facility. The oxygen stream (preferably liquid oxygen) and nitrogen stream are directed to a combined densification system where the liquid oxygen is densified and a source of methane is also liquefied and/or densified, as described in more detail below with reference to FIG. 4.

The resulting products are a densified liquid oxygen product suitable for use in rocket launch applications and may be referred to by the tradename ROX™ and a densified liquid methane product suitable for use as a rocket fuel. Multiple trailers of the densified liquid oxygen product (i.e. ROX™) and densified liquid methane are delivered via trucks to a launch facility and either stored in appropriate storage tanks and/or directly to the space vehicle. To maintain the subcooled level of the densified liquid oxygen product, an optional subcooler unit may be integrated with the storage tanks to keep the product at the desired temperature. A clear advantage of the improved supply arrangement depicted in FIG. 1C is that there is no needed transport or storage of liquid nitrogen to or at the launch facility and this arrangement is able to serve multiple customers or multiple launch facilities in a given region.

In both improved supply arrangements depicted in FIGS. 1B and 1C, liquid storage tanks are also preferably located at the launch facility to store the densified liquid oxygen and any liquid fuels (e.g. liquid methane or densified liquid methane) produced from the combined liquefaction and densification system or other liquid products such as liquid nitrogen needed at the launch facility. Although not shown, the liquefaction and densification system and/or components thereof may be disposed on moveable platforms that can be aggregated at a central location within the launch facility or can be readily moved to a location proximate a space vehicle launch platform.

Figure 2:
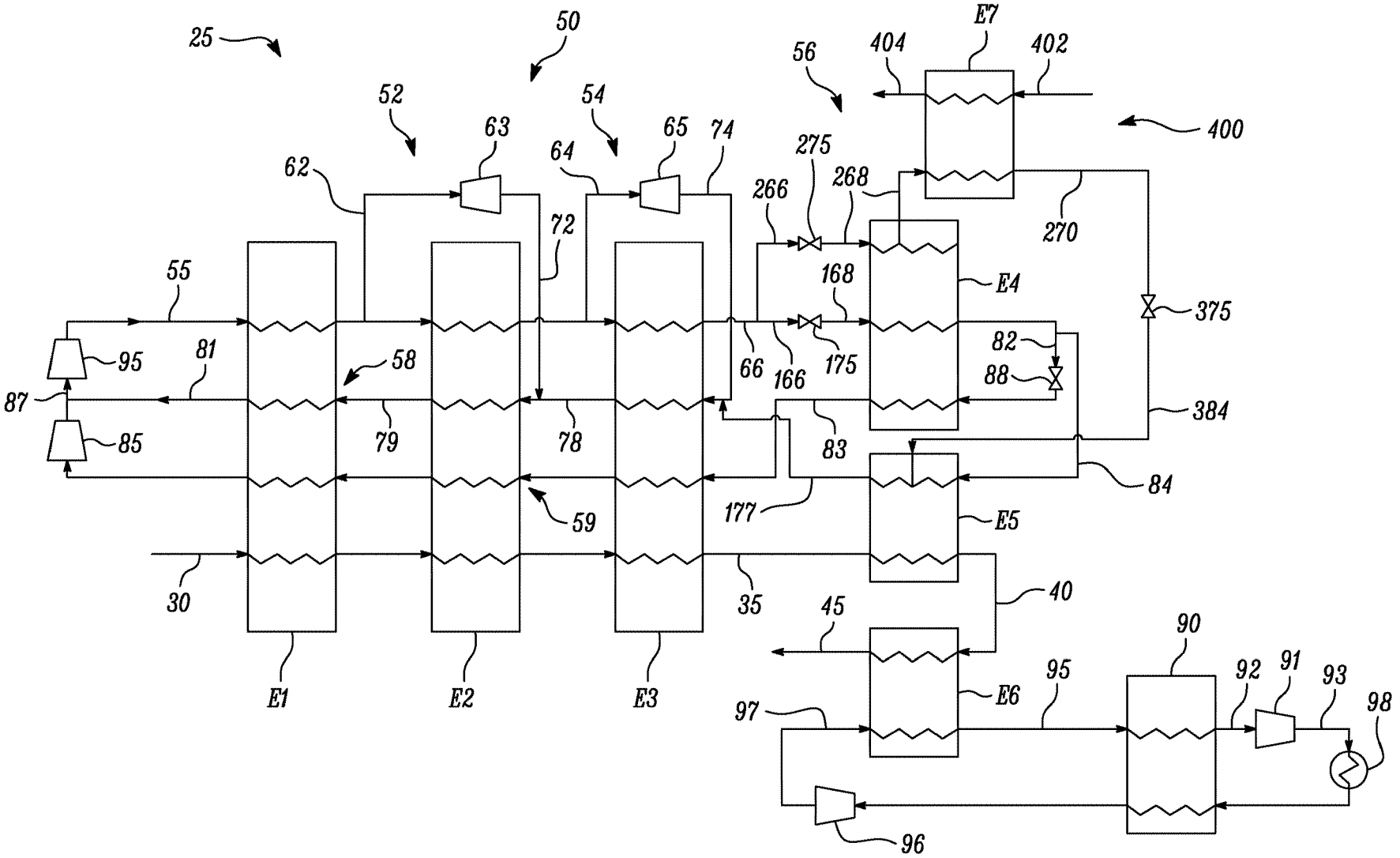
FIG. 2 shows a schematic of an embodiment of a system and method for the combined liquefaction of a gaseous oxygen stream and densification of the resulting liquid oxygen stream.
Figure 5:
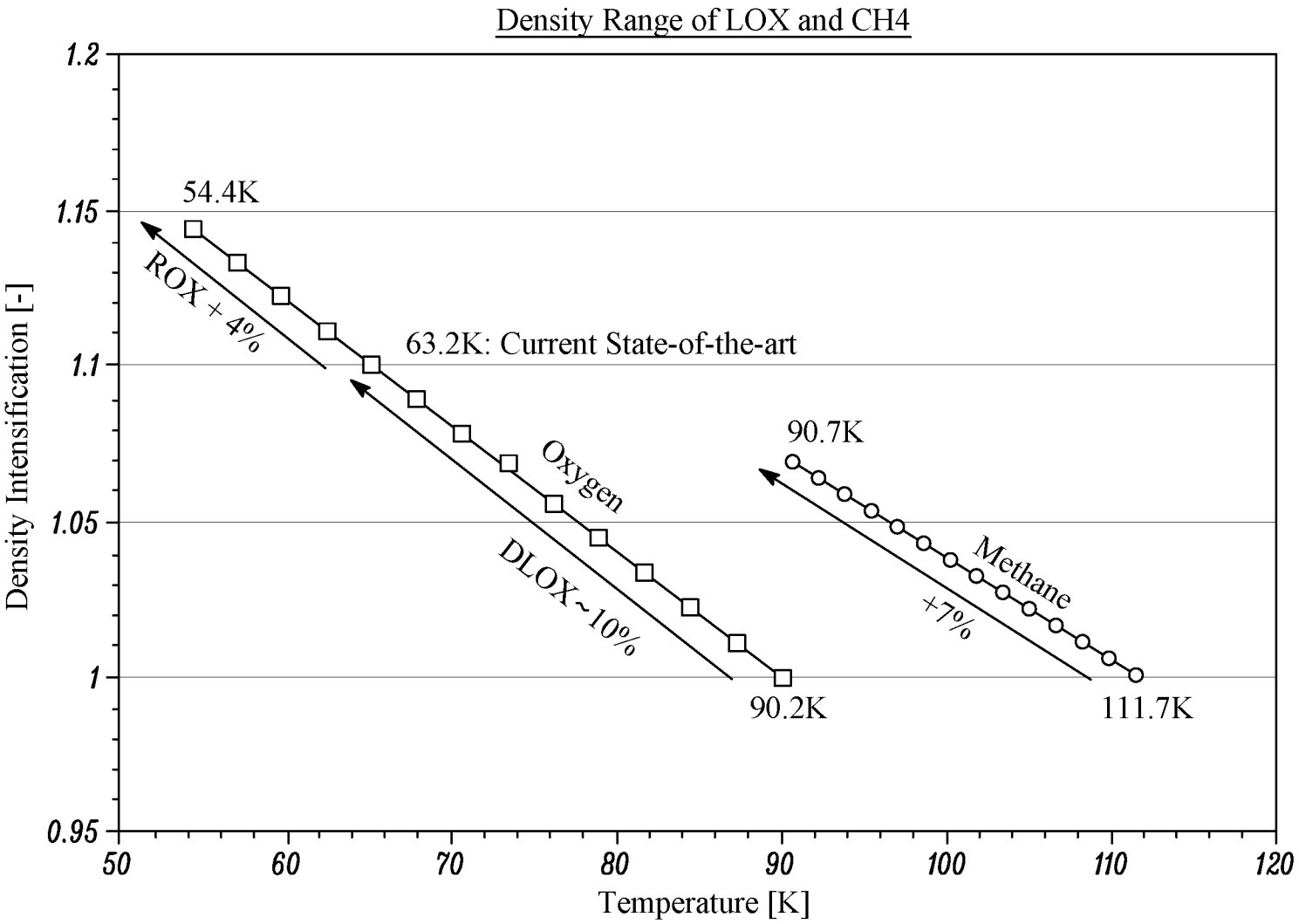
FIG. 5 is a graph that depicts the density range of liquid oxygen and liquid methane achievable with the present arrangements.

Turning now to FIG. 2, the illustrated combined liquefaction and densification system 25 and associated methods utilize two refrigeration stages, including a first refrigeration stage and a second refrigeration stage. The first refrigeration stage is preferably a nitrogen based refrigerant arrangement, such as a reverse Brayton cycle refrigeration cycle, that liquefies a source of gaseous oxygen 30 and subcools the resulting liquid oxygen 40 to a temperature of about 81 Kelvin. The second refrigeration stage is a mixed refrigerant loop containing some combination of helium and/or neon refrigerants with maybe small amounts of other gases such as nitrogen and oxygen that is used to further subcool and densify the liquid oxygen 40 to yield a densified liquid oxygen stream 45 a temperature of between about 54 Kelvin to 57 Kelvin. As shown in FIG. 5, the densified liquid oxygen product at this temperature represents between about 10% to 14% increase in density compared to conventional liquid oxygen product and about 4% increase in density compared to conventional oxygen densification processes.

The first refrigeration stage uses a high pressure nitrogen refrigerant stream 55 at a pressure of about 50 bar(a) that is cooled a first heat exchanger 50 that can be segmented into a plurality of heat exchange sections, E1, E2, E3. To cool the high pressure nitrogen refrigerant stream 55, the first heat exchanger 50 is configured to include a first warm refrigeration circuit 52, a second cold refrigeration circuit 54, a residual refrigeration circuit 56, and one or more recycle circuits 58,59.

The nitrogen refrigerant stream 55 is referred to as a first refrigerant stream and is preferably split into three portions as it traverses the first heat exchanger 50, namely a first warm portion 62 of the first refrigerant stream that traverses through the first warm refrigeration circuit 52, a second cold portion 64 of the first refrigerant stream that traverses through the second cold refrigeration circuit 54, and a residual portion 66 of the first refrigerant stream that traverses through the residual refrigeration circuit 56. Upon exiting the first warm refrigeration circuit, the second cold refrigeration circuit, or the residual refrigeration circuit, the respective portions of the first refrigerant stream are recycled in one or more recycle circuits 58, 59.

The first refrigeration stage also preferably includes a warm turbine 63 configured to expand the first warm portion 62 the first refrigerant stream to yield an intermediate pressure warm exhaust 72 at a pressure of about 6 bar(a) and a cold turbine 65 configured to expand the second cold portion 64 the first refrigerant stream to yield an intermediate pressure cold exhaust 74 also at a pressure of about 6 bar(a). The warm exhaust 72 and the cold exhaust 74 are recycled in the one or more recycle circuits 58 to cool the low pressure gaseous oxygen stream 30 and the nitrogen refrigerant stream 55.

More specifically, the intermediate pressure cold exhaust 74 is mixed with an intermediate pressure recycle stream 77 before being fed into the cold end of exchanger section E3 where the mixed stream (with cold exhaust) is warmed to provide refrigeration for the cooling of the gaseous oxygen stream 30 and the nitrogen refrigeration stream 55. Similarly, the intermediate pressure warm exhaust 72 is also mixed with intermediate pressure recycle stream 78 before being fed into the cold end of exchanger section E2 where it also provides refrigeration for the cooling of the gaseous oxygen stream 30 and nitrogen refrigeration stream 55. The combined intermediate pressure recycle stream 79 (including the cold exhaust and warm exhaust) is further warmed in heat exchange section E1 to yield a fully warmed, intermediate pressure nitrogen recycle stream 81, which is then compressed in one or more recycle compressors 95.

The residual portion 66 of the first refrigerant stream is further cooled in heat exchange section E3 of the first heat exchanger and then expanded preferably using one or more expansion valves, including a first expansion valve 75. Prior to expansion, the residual portion 66 of the high pressure first refrigerant stream is at a temperature above its critical point, so that no phase transition occurs. However, once the residual portion 66 of the first refrigerant stream is expanded or 'flashed' to an intermediate pressure it may exist in the liquid phase. The pseudo-liquefaction is advantageous because it eliminates the constant temperature phase transition that can create a large 'Delta-T' in the first heat exchanger composite curve. A large 'Delta-T' represents an inefficiency and an increase in power consumption.

The intermediate pressure liquid nitrogen stream 168 is then subcooled in a nitrogen subcooler E4. A first portion 82 of the subcooled, intermediate pressure liquid nitrogen is further expanded or 'flashed' in expansion valve 88 to form a low pressure nitrogen refrigerant stream 83 at a pressure of about 1.5 bar(a) that is used to subcool the intermediate pressure liquid nitrogen 168 in the nitrogen subcooler E4. The now boiled, low pressure nitrogen refrigerant stream 83 is recycled via recycle circuit 59 through heat exchanger sections E3, E2, and E1 where it is further warmed to about ambient temperatures. Upon exiting the heat exchanger sections, the warmed, low pressure return stream 86 is compressed in a multi-stage feed compressor 85 and mixed with the fully warmed, intermediate pressure nitrogen recycle stream 81. The combined recycle stream 87 is further compressed in a multi-stage recycle compressor 95 to form the high pressure nitrogen refrigerant stream 55. Make up nitrogen 99, preferably from the nearby air separation unit, can be supplied at various points in the process depending on the pressure and phase of the nitrogen source.

The first refrigeration stage also includes a subcooler E5 that is configured to receive a second portion 84 of the subcooled, intermediate pressure liquid nitrogen which provides the refrigeration necessary to subcool and liquefy the cooled, low pressure gaseous oxygen stream 30 via indirect heat exchange between the two streams to yield the low pressure liquid oxygen stream 40. The warmed or boiled, intermediate pressure recycle stream 77 is then recycled via one or more recycle circuits 58 and further warmed in heat exchanger sections E3, E2, and E1.

The gaseous oxygen stream 30, preferably piped in from the nearby air separation unit, enters combined liquefaction and densification system at a relatively low pressure that will allow its boiling point to match up well with the condensation of the intermediate pressure liquid nitrogen 168. In the current embodiments, the low pressure gaseous oxygen stream 30 is at a pressure of between 1.5 bar(a) and 3.0 bar(a), or higher, and more preferably at a pressure of about 2.3 bar(a). The low pressure gaseous oxygen stream 30 is then cooled to near its condensation temperature in heat exchanger sections E1, E2, and E3 of the first heat exchanger 50. The cooled, low pressure gaseous oxygen stream 35 is then liquefied and subcooled in subcooler E5 via indirect heat exchange against the subcooled, intermediate pressure liquid nitrogen stream 84. While the current drawings depict subcooler E5 as a single heat exchange vessel, the use of multiple heat exchange vessels could be considered in this approach such as a first vessel configured as an evaporator section and a second vessel configured as a sensible heat section. As indicated above, the resulting liquid oxygen stream 40 is at a temperature of 81 Kelvin.

The subcooled liquid oxygen stream 40 is cooled even further, and thus densified, to a temperature of between about 54 Kelvin and 57 Kelvin in a densification heat exchanger E6. The cooling occurs against a second mixed refrigerant stream 95 comprising helium, neon, or combinations of helium and neon. The second mixed refrigerant stream 95 may also include small amounts of other gases such as nitrogen and oxygen.

The densification heat exchanger E6 and second mixed refrigerant stream 95 form part of the second refrigeration stage, which is preferably a closed loop refrigeration stage. As shown in the drawings, the second refrigeration stage is configured to flow the neon and/or helium containing second mixed refrigerant 95 through a second heat exchanger 90 and the densification heat exchanger E6. The second refrigeration stage also includes a second refrigerant recycle compressor 91 disposed downstream of the second heat exchanger 90 and configured to compress the second mixed refrigerant feed 92 to yield the compressed second mixed refrigerant 93 and an aftercooler 98 configured to cool the compressed second mixed refrigerant 93 to ambient temperature.

The second refrigeration stage also includes a second refrigerant turbine 96 disposed downstream of the second heat exchanger 90 and upstream of the densification heat exchanger E6. The second refrigerant turbine 96 is configured to expand the compressed second mixed refrigerant 93 to yield an exhaust stream 97 that provides the refrigeration for the densification heat exchanger E6 necessary to the further subcool the liquid oxygen stream 40 and yield a densified, liquid oxygen stream 45. The partially warmed second mixed refrigerant 95 exiting the densification heat exchanger E6 is further warmed in second heat exchanger 90 to create the second mixed refrigerant feed 92 to the second refrigerant recycle compressor 91. The partially warmed second mixed refrigerant can be further warmed to ambient temperature or be left somewhat below ambient temperature to take advantage of the power savings from cold compression in the second refrigerant recycle compressor 91. The process would have a make-up system on site to account for potential refrigerant losses over time and/or utilize liquid nitrogen from a storage tank for liquid assist or backup densification.

In addition to the work supplied by the warm turbine and cold turbine, the external power required to drive the multi-stage compressors are preferably obtained from renewable energy sources, such as solar power sources, located or disposed at the launch facility. As the need for densified liquid oxygen at the launch facility is typically an intermittent requirement at or near a space vehicle launch window, the use of renewable power sources, such as solar power, for the present system and methods is ideal.

In the embodiment depicted in FIG. 2, the residual portion 66 of the high pressure first refrigerant stream is split into two fractions, including a first high pressure residual fraction 166 and a second high pressure residual fraction 266.

Each fraction is expanded or 'flashed' in an expansion valve to a specific pressure, which are set to fix the boiling temperature of each stream. The first high pressure residual fraction 166 is expanded or 'flashed' in expansion valve 175 to a pressure of about 6.0 bar(a) and the resulting intermediate pressure stream 168 is directed to and received by the subcooler E4 where it is subcooled, as detailed above. The second high pressure residual fraction 266 is also expanded or 'flashed' in a second expansion valve 275 to a pressure of about 15.0 bar(a) and the resulting moderate pressure stream 268 is diverted via E4 to a liquid methane densification system 400. This higher pressure of the expanded second fraction 268 sets the boiling point of the nitrogen stream to a value just below the temperature of the feed liquid methane stream 402. This allows this liquid nitrogen stream 268 to be used to subcool and densify the liquid methane in the methane subcooler E7 without boiling it and yields a subcooled, densified liquid methane stream 404 at a temperature of about 90.7 Kelvin, which as shown in FIG. 5 is about 7% higher in density than conventional liquid methane at 111.7 Kelvin. This close temperatures between the expanded second fraction 268 and the feed liquid methane stream 402 also creates a close pinch along the entire length of the heat exchange passages in methane subcooler E7. The warmed, liquid nitrogen stream 270 exiting methane subcooler E7 is further expanded in expansion valve 375 to yield expanded stream 384 at a pressure equal to the second portion 84 of the subcooled, intermediate pressure liquid nitrogen.

In this embodiment, the first refrigeration stage also includes subcooler E5 that is configured to receive the second portion 84 of the subcooled, intermediate pressure liquid nitrogen and the expanded stream 384 which provides the refrigeration necessary to subcool the liquid oxygen product to a temperature of about 81 Kelvin via indirect heat exchange between the two streams to yield the low pressure liquid oxygen stream 40. The warmed intermediate pressure recycle stream 177 exiting subcooler E5 is then recycled via one or more recycle circuits 58 and further warmed in heat exchanger sections E3, E2, and E1 together with the other intermediate pressure recycle streams to ambient temperatures prior to re-compression in the recycle compressor 95.

Figure 3:
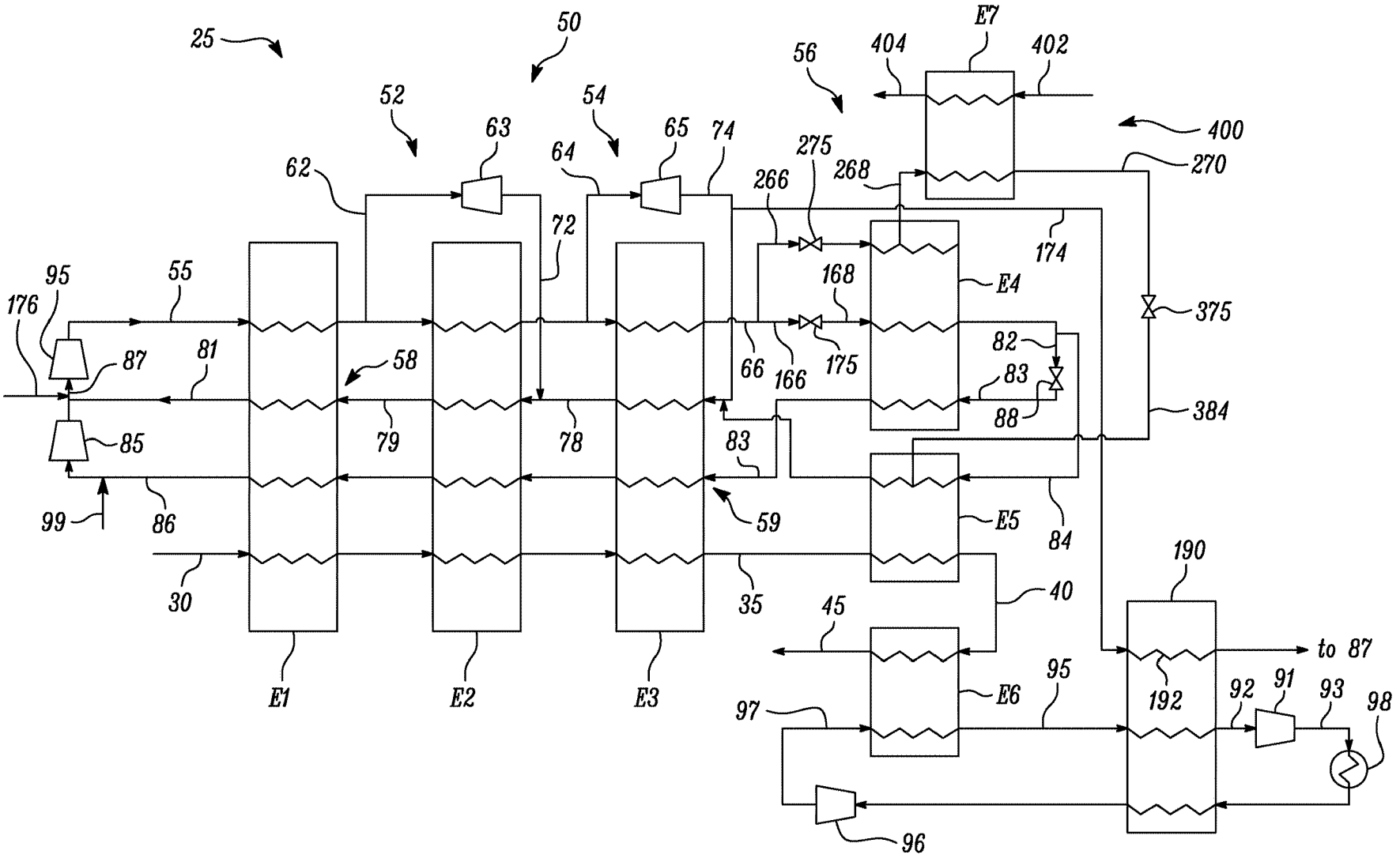
FIG. 3 shows a detailed schematic of an embodiment of an integrated system and method for the liquefaction and densification of oxygen and densification of liquid methane.

The process flow diagrams depicted in FIG. 3 is very similar to the process flow diagram of FIG. 2 described above and, for sake of brevity, much of the descriptions of the detailed arrangements will not be repeated. Rather, the following discussion will focus on the differences and additions depicted in the process flow diagram of FIG. 3 when compared to the process flow diagram depicted in FIG. 2.

In the embodiment depicted in FIG. 3, a diverted portion 174 of the intermediate pressure cold exhaust 74 is directed to an auxiliary warming passage 192 in the second heat exchanger 190 where it further cools the compressed, helium or neon containing second mixed refrigerant 95 via indirect heat exchange. The warmed diverted stream 176 is then recycled back to the recycle compressor 95 where it is recombined with the combined recycle stream 87 and further compressed in a multi-stage recycle compressor 95 to form the high pressure nitrogen refrigerant stream 55. In this embodiment there is further integration between the first refrigeration stage and the second refrigeration stage.

In addition, the residual portion 66 of the high pressure first refrigerant stream is split into two fractions, including the first high pressure residual fraction 166 and the second high pressure residual fraction 266. Similar to the embodiment of FIG. 2, the first high pressure residual fraction 166 is expanded or 'flashed' in expansion valve 175 to a pressure of about 6.0 bar(a) while the second high pressure residual fraction 266 is 'flashed' in a second expansion valve 275 to a pressure of about 15.0 bar(a). The resulting intermediate pressure stream 168 is directed to and received by the subcooler E4 where it is subcooled while the resulting moderate pressure stream 268 is diverted to the liquid methane densification system 400. The warmed, liquid nitrogen stream 270 exiting the methane subcooler E7 is further expanded or 'flashed' in another expansion valve 375 to yield expanded stream 384 at a pressure about equal to the second portion 84 of the subcooled, intermediate pressure liquid nitrogen.

Subcooler E5 is configured to receive the second portion 84 of the subcooled, intermediate pressure liquid nitrogen and the expanded stream 384 which provides the refrigeration necessary to subcool the liquid oxygen and yield the low pressure liquid oxygen stream 40. The warmed intermediate pressure recycle stream 177 exiting subcooler E5 is then recycled via one or more recycle circuits 58 and further warmed in heat exchanger sections E3, E2, and E1 together with the other intermediate pressure recycle streams to ambient temperatures.

Figure 4:
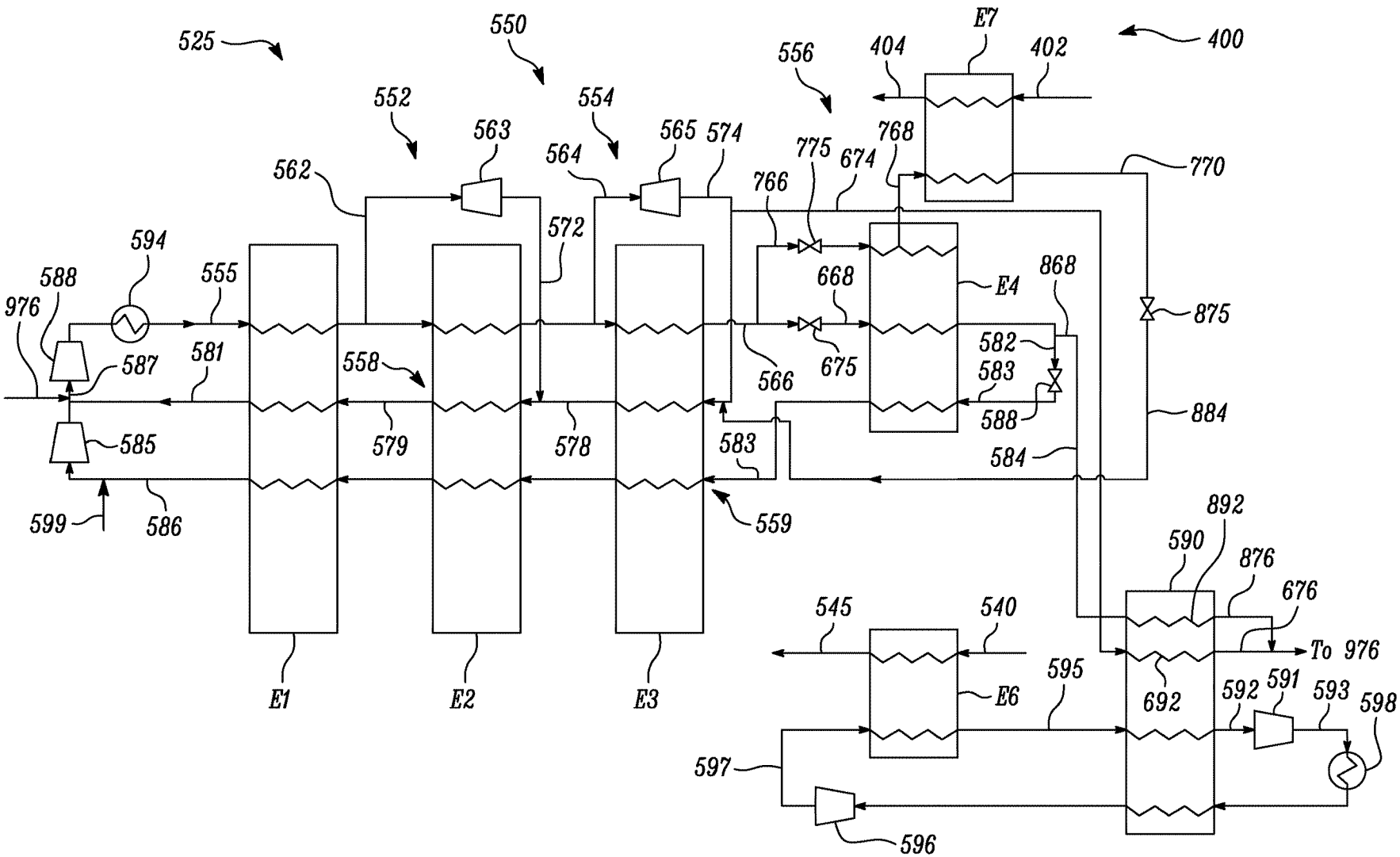
FIG. 4 shows a schematic of an embodiment of a system and method for the densification of a liquid oxygen stream and densification of a liquid methane stream.

Turning to FIG. 4, the illustrated system 525 and associated methods provide for the densification of a liquid oxygen stream. The illustrated system and method utilize two refrigeration stages, including a first refrigeration stage and a second refrigeration stage. The first refrigeration stage is preferably a nitrogen based refrigerant arrangement, such as a reverse Brayton cycle refrigeration cycle, that provides refrigeration for the second refrigeration stage. The second refrigeration stage is a helium or neon containing refrigerant loop containing some combination of helium and/or neon refrigerants with maybe small amounts of other gases such as nitrogen and oxygen that is used to further subcool and densify a liquid oxygen stream 540 to yield a densified liquid oxygen stream 545 at a temperature of between about 70 Kelvin to 57 Kelvin. The stream of liquid oxygen 540 is preferably received from a liquid oxygen storage tank (not shown) associated with a liquid producing air separation unit (not shown) or can be taken directly from the liquid producing air separation unit.

The first refrigeration stage uses a high pressure nitrogen refrigerant stream 555 at a pressure of about 50 bar(a) that is cooled a first heat exchanger 550 that can be segmented into a plurality of heat exchange sections, E1, E2, E3. To cool the high pressure nitrogen refrigerant stream 555, the first heat exchanger 550 is configured to include a first warm refrigeration circuit 552, a second cold refrigeration circuit 554, a residual refrigeration circuit 56, and one or more recycle circuits 558, 559.

The nitrogen refrigerant stream 555 is referred to as a first refrigerant stream and is preferably split into three portions as it traverses the first heat exchanger 550, namely a first warm portion 562 of the first refrigerant stream that traverses through the first warm refrigeration circuit 552, a second cold portion 564 of the first refrigerant stream that traverses through the second cold refrigeration circuit 554, and a residual portion 566 of the first refrigerant stream that traverses through the residual refrigeration circuit 556. Upon exiting the first warm refrigeration circuit, the second cold refrigeration circuit, or the residual refrigeration circuit, the respective portions of the first refrigerant stream are recycled in one or more recycle circuits 558, 559.

The first refrigeration stage also preferably includes a warm turbine 563 configured to expand the first warm portion 562 the first refrigerant stream to yield an intermediate pressure warm exhaust 572 at a pressure of about 6 bar(a) and a cold turbine 565 configured to expand the second cold portion 564 the first refrigerant stream to yield an intermediate pressure cold exhaust 574 also at a pressure of about 6 bar(a). The warm exhaust 572 and the cold exhaust 574 are recycled in the one or more recycle circuits 558 to cool the nitrogen refrigerant stream 555.

More specifically, the intermediate pressure cold exhaust 574 is mixed with an intermediate pressure recycle stream 577 before being fed into the cold end of exchanger section E3 where the mixed stream (with cold exhaust) is warmed to provide refrigeration for the cooling of the nitrogen refrigeration stream 555. Similarly, the intermediate pressure warm exhaust 572 is also mixed with intermediate pressure recycle stream 578 before being fed into the cold end of exchanger section E2 where it also provides refrigeration for the cooling of the nitrogen refrigeration stream 555. The combined intermediate pressure recycle stream 579 (including the cold exhaust and warm exhaust) is further warmed in heat exchange section E1 to yield a fully warmed, intermediate pressure nitrogen recycle stream 581, which is then compressed in one or more recycle compressors 695.

The residual portion 566 of the first refrigerant stream is further cooled in heat exchange section E3 of the first heat exchanger and then expanded preferably using one or more expansion valves, including a first expansion valve 575. Prior to expansion, the residual portion 566 of the high pressure first refrigerant stream is at a pressure above its critical point, so that little or no phase transition occurs. However, once the residual portion 566 of the first refrigerant stream is expanded or 'flashed' to an intermediate pressure it may exist in the liquid phase or in a dual phase. As explained above, the pseudo-liquefaction is advantageous.

The intermediate pressure liquid nitrogen stream 668 is then subcooled in a nitrogen subcooler E4. A first portion 582 of the subcooled, intermediate pressure liquid nitrogen is further expanded or 'flashed' in expansion valve 588 to form a low pressure nitrogen refrigerant stream 583 at a pressure of about 1.5 bar(a) that is used to subcool the intermediate pressure liquid nitrogen 668 in the nitrogen subcooler E4. The now boiled, low pressure nitrogen refrigerant stream 583 is recycled via recycle circuit 559 through heat exchanger sections E3, E2, and E1 where it is further warmed to about ambient temperatures. Upon exiting the heat exchanger sections, the warmed, low pressure return stream 586 is compressed in a multi-stage feed compressor 685 and mixed with the fully warmed, intermediate pressure nitrogen recycle stream 581. The combined recycle stream 587 is further compressed in a multi-stage recycle compressor 695 to form the high pressure nitrogen refrigerant stream 555. Make up nitrogen 599 can be supplied at various points in the process depending on the pressure and phase of the nitrogen source.

The liquid oxygen stream 540, preferably taken from a storage tank or directly from an air separation unit, enters densification system at a relatively low pressure that will allow its boiling point to match up well with the condensation of the intermediate pressure liquid nitrogen 668. In the current embodiments, the liquid oxygen stream 540 is at a pressure of between about 1.3 bar(a) and 25.0 bar(a), and more preferably between 1.3 bar(a) and about 3.0 bar(a) and still more preferably at a pressure of about 2.3 bar(a). The liquid oxygen stream 540 is likely at a temperature of around 81 Kelvin.

The liquid oxygen stream 540 is subcooled and thus densified, to a temperature of between about 70 Kelvin and between about 54 Kelvin to 57 Kelvin in a densification heat exchanger E6. The cooling occurs against a second refrigerant stream 595 comprising helium, neon, or combinations of helium and neon. The second refrigerant stream 595 may also include small amounts of other gases such as nitrogen and oxygen. As indicated above and depicted in the graph in FIG. 5, the densified liquid oxygen product at this temperature represents between about 10% to about 14% increase in density compared to a conventional liquid oxygen product and about 4% increase in density compared to conventional oxygen densification processes.

The densification heat exchanger E6 and second refrigerant stream 595 form part of the second refrigeration stage. As shown in the drawings, the second refrigeration stage is configured to flow the neon and/or helium containing second refrigerant stream 595 through a second heat exchanger 590 and the densification heat exchanger E6. The second refrigeration stage also includes a second refrigerant recycle compressor 591 disposed downstream of the second heat exchanger 590 and configured to compress the second refrigerant feed 592 to yield the compressed second refrigerant 593 and an aftercooler 598 configured to cool the compressed second refrigerant 593 to ambient temperature.

The second refrigeration stage also includes a second refrigerant turbine 596 disposed downstream of the second heat exchanger 590 and upstream of the densification heat exchanger E6. The second refrigerant turbine 596 is configured to expand the compressed second refrigerant 593 to yield an exhaust stream 597 that provides the refrigeration for the densification heat exchanger E6 necessary to the further subcool the liquid oxygen stream 540 and yield a densified, liquid oxygen stream 545. The partially warmed second refrigerant stream 595 exiting the densification heat exchanger E6 is further warmed in second heat exchanger 590 to create the second refrigerant feed 592 to the second refrigerant recycle compressor 591. The partially warmed second refrigerant can be further warmed to ambient temperature or be left somewhat below ambient temperature to take advantage of the power savings from cold compression in the second refrigerant recycle compressor 591. The process would have a make-up system on site to account for potential refrigerant losses over time and/or utilize liquid nitrogen from a storage tank for liquid assist or backup densification.

The embodiment depicted in FIG. 4 also optionally includes an integrated configuration between the first refrigeration stage and the second refrigeration stage. As seen therein, the diverted portion 674 of the intermediate pressure cold exhaust 574 is directed to the auxiliary warming passage 692 in the second heat exchanger 590 where it further cools the compressed, helium or neon containing second refrigerant stream 595 via indirect heat exchange. In addition, a diverted portion 868 of intermediate pressure stream 668 is also directed to another auxiliary warming passage 892 in the second heat exchanger 590 where it also cools the compressed, helium or neon containing second refrigerant stream 595 via indirect heat exchange. The warmed diverted stream 876 is then mixed with the warmed diverted stream 676 and the combined stream 976 is recycled back to the recycle compressor 695 where it is recombined with the combined recycle stream 587 and further compressed in a multi-stage recycle compressor 695 to form the high pressure nitrogen refrigerant stream 555.

The embodiment depicted in FIG. 4 also includes an integrated liquid methane densification system 400. When using the integrated liquid methane densification system 400, the residual portion 566 of the high pressure first refrigerant stream is preferably split into two fractions, including the first high pressure residual fraction 666 and the second high pressure residual fraction 766. The first high pressure residual fraction 666 is expanded or 'flashed' in expansion valve 675 to a pressure of about 6.0 bar(a) while the second high pressure residual fraction 766 is 'flashed' in a second expansion valve 775 to a pressure of about 15.0 bar(a). The resulting intermediate pressure stream 668 is directed to and received by the subcooler E4 where it is subcooled while the resulting moderate pressure stream 768 is diverted to the liquid methane densification system 400. The warmed, liquid nitrogen stream 770 exiting the methane subcooler E7 is further expanded or 'flashed' in another expansion valve 875 to yield expanded stream 884 at a pressure about equal to the second portion 584 of the subcooled, intermediate pressure liquid nitrogen.

While the embodiments depicted in FIGS. 2-4 show only the liquid methane densification system, it is contemplated to further integrate a nitrogen based methane liquefaction system and/or methane purification system. Examples of nitrogen based methane liquefaction arrangements would be those systems shown and described in U.S. patent application Ser. No. 17/717,182; Ser. No. 17/717,189; Ser. No. 17/717,193; and Ser. No. 17/717,197 filed on Apr. 11, 2022 and Ser. No. 17/716,033; Ser. No. 17/716,065; Ser. No. 17/716,088; Ser. No. 17/716,103; Ser. No. 17/716,131; and Ser. No. 17/716,153 filed on Apr. 8, 2022, the disclosures of which are incorporated by reference herein.

While the present systems and methods for the co-production of a densified liquid oxygen product and densified liquid methane product have been described with reference to one or more preferred embodiments, it is understood that numerous additions, changes, and omissions can be made without departing from the spirit and scope of the present systems and methods as set forth in the appended claims.

What is claimed is:

1. A system for co-production of a densified, liquid oxygen stream and a densified liquid methane stream comprising:

a first refrigeration stage comprising a first primary heat exchanger and a first subcooler;

wherein the first primary heat exchanger is configured to cool a gaseous oxygen stream via indirect heat exchange with one or more intermediate pressure recycle streams of a first refrigerant and one or more low pressure refrigerant streams of the first refrigerant which are configured to flow through the first primary heat exchanger to yield a cooled gaseous oxygen stream;

wherein the first subcooler is configured to liquefy and subcool the cooled gaseous oxygen stream via indirect heat exchange with a residual portion of a first intermediate pressure liquid stream of the first refrigerant to yield a subcooled liquid oxygen stream;

a second refrigeration stage comprising a second heat exchanger configured to flow a second refrigerant through the second heat exchanger to further subcool the liquid oxygen stream and yield the densified, liquid oxygen stream; and a third refrigeration stage comprising a third heat exchanger configured to densify a stream of liquid methane via indirect heat exchange with a diverted portion of a second intermediate pressure liquid stream of the first refrigerant to yield a densified, liquid methane stream.

2. The system of claim 1 wherein the first refrigeration stage further comprises:

a first warm refrigeration circuit, a second cold refrigeration circuit, a residual refrigeration circuit, and one or more recycle circuits;

wherein the first refrigerant is configured to be split into a first warm portion of the first refrigerant in the first warm refrigeration circuit, a second cold portion of the first refrigerant in the second cold refrigeration circuit, the diverted portion of the second intermediate pressure liquid stream of the first refrigerant, and the residual portion of the first intermediate pressure liquid stream of the first refrigerant in the residual refrigeration circuit;

a warm turbine configured to expand the first warm portion of the first refrigerant to yield an intermediate pressure warm exhaust;

a cold turbine configured to expand the second cold portion of the first refrigerant to yield an intermediate pressure cold exhaust;

an expansion valve for expanding the residual portion of the first refrigerant to form an intermediate pressure liquid stream;

wherein the warm exhaust and the cold exhaust are configured to be recycled in the one or more recycle circuits via the first primary heat exchanger to form a recycled warm exhaust and a recycled cold exhaust respectively part of the one or more intermediate pressure recycle streams of the first refrigerant and to cool the gaseous oxygen stream;

wherein the first subcooler is configured to receive at least a part of the intermediate pressure liquid stream as the residual portion of the intermediate pressure liquid stream of the first refrigerant and yield a first refrigerant return stream that is configured to be recycled via the one or more recycle circuits to form a recycled first refrigerant return stream; and one or more first refrigerant recycle compressors configured to compress the recycled warm exhaust, the recycled cold exhaust, and the recycled first refrigerant return stream.

3. The system of claim 1 wherein the first refrigerant comprises nitrogen and the second refrigerant comprises a nitrogen and neon containing mixture.

4. The system of claim 3 wherein the second refrigeration stage is a closed loop refrigeration stage and further comprises:

a second refrigerant recycle compressor disposed downstream of the second heat exchanger and configured to compress the second refrigerant; and a second refrigerant turbine disposed upstream of the second heat exchanger and configured to expand the compressed second refrigerant.

5. The system of claim 2 wherein:

the intermediate liquid stream is configured to be split into a first expanded residual portion and a second expanded residual portion;

wherein the first expanded residual portion is configured to be further expanded to yield a low pressure nitrogen refrigerant stream and wherein the low pressure nitrogen refrigerant stream is configured to be recycled via the first primary heat exchanger as one of the one or more low pressure refrigerant streams of a first refrigerant—to yield a low pressure return stream; and wherein the low pressure return stream is configured to be compressed in the one or more first refrigerant recycle compressors.

6. The system of claim 5 wherein the first refrigeration stage further comprises a nitrogen subcooler configured to subcool the intermediate pressure stream upstream of where the intermediate pressure stream is configured to be split into the first expanded residual portion and the second expanded residual portion via indirect heat exchange with the low pressure nitrogen refrigerant stream.

7. A system for co-production of a densified, liquid oxygen stream and a densified liquid methane stream, the system comprises:

a first refrigeration stage configured to receive a first refrigerant and flow the first refrigerant through at least one first heat exchanger;

a second refrigeration stage configured to flow a second refrigerant through a second heat exchanger configured to cool the second refrigerant via indirect heat exchange with one or more streams of the first refrigerant and configured to flow the second refrigerant through a densification heat exchanger to further subcool and densify a liquid oxygen stream via indirect heat exchange with the second refrigerant;

a third refrigeration stage comprising a third heat exchanger configured to densify a stream of liquid methane via indirect heat exchange with a diverted portion of an intermediate pressure liquid stream from the first refrigeration stage to yield the densified, liquid methane stream.

8. The system of claim 7 wherein the first refrigeration stage further comprises:

a first warm refrigeration circuit, a second cold refrigeration circuit, a residual refrigeration circuit, and one or more recycle circuits;

wherein the first refrigerant that is configured to flow through the first heat exchanger is configured to be split into a first warm portion of the first refrigerant in the first warm refrigeration circuit, a second cold portion of the first refrigerant in the second cold refrigeration circuit, and a residual portion of the first refrigerant in the residual refrigeration circuit;

a warm turbine configured to expand the first warm portion of the first refrigerant to yield an intermediate pressure warm exhaust;

a cold turbine configured to expand the second cold portion of the first refrigerant to yield an intermediate pressure cold exhaust;

an expansion valve for expanding the residual portion of the first refrigerant to yield an expanded residual stream;

wherein the warm exhaust, the cold exhaust, and at least a part of the expanded residual stream are configured to be recycled in the one or more recycle circuits to form a recycled warm exhaust, a recycled cold exhaust, and a recycled expanded residual stream respectively to cool the first refrigerant; and one or more first refrigerant recycle compressors configured to compress the recycled warm exhaust, the recycled cold exhaust, and the recycled expanded residual stream.

9. The system of claim 8 wherein the first refrigerant comprises nitrogen and the second refrigerant comprises helium or neon or both helium and neon.

10. The system of claim 9 wherein the second refrigeration stage is a closed loop refrigeration stage and further comprises:

a second refrigerant recycle compressor disposed downstream of the second heat exchanger and configured to compress the second refrigerant; and a second refrigerant turbine disposed upstream of the second heat exchanger and configured to expand the compressed second refrigerant.

11. The system of claim 8 wherein:

the expanded residual stream is configured to be split into a first expanded residual stream and a second expanded residual stream that is at least part of the expanded residual stream;

the first expanded residual stream is configured to be further expanded to yield a low pressure nitrogen refrigerant stream and wherein the low pressure nitrogen refrigerant stream is then configured to be recycled via the first heat exchanger to yield a low pressure return stream as the recycled expanded residual stream; and the second expanded residual stream is one of the one or more streams of the first refrigerant that is configured to flow through the second heat exchanger to cool the second refrigerant.

12. The system of claim 11 wherein the second expanded residual stream is configured to be recycled to the one or more of the first refrigerant recycle compressors.

13. The system of claim 11 wherein the one or more streams of the first refrigerant that is configured to flow through the second heat exchanger further comprises a diverted portion of the cold exhaust.

14. The system of claim 13 wherein the diverted portion of the cold exhaust is configured to be recycled to the one or more first refrigerant recycle compressors upon exiting the second heat exchanger.

* * * * *